US005971828A

United States Patent [19]

Lin

[11] Patent Number: 5,971,828

[45] Date of Patent: Oct. 26, 1999

[54] TOY WINDMILL

[76] Inventor: Chen-Hsiung Lin, No. 174, Ding Tan, Pi Tan Village, Lu Tsao Hsian, Chia Yi Hsien, Taiwan

[21] Appl. No.: 09/178,483

[22] Filed: Oct. 26, 1998

[51] Int. Cl.[6] ..... A63H 33/40

[52] U.S. Cl. ..... 446/217

[58] Field of Search ..... 446/176, 217, 446/218, 236, 266

[56] References Cited

U.S. PATENT DOCUMENTS

| | | | |
|---|---|---|---|
| 903,879 | 11/1908 | Jusly, Jr. | 446/218 |
| 1,155,263 | 9/1915 | Naito | 446/218 |
| 3,252,241 | 5/1966 | Gould | 446/217 |
| 3,475,850 | 11/1969 | Hop Lee | 446/217 |
| 3,837,112 | 9/1974 | Peterson | 446/218 |
| 4,907,800 | 3/1990 | Passamaneck et al. | 446/218 X |

*Primary Examiner*—D Neal Muir
*Attorney, Agent, or Firm*—Rosenberg, Klein & Bilker

[57] ABSTRACT

A toy windmill includes a leaf member and a rod member. The rod member consists of a first large diameter grip rod, a small diameter shaft extending from an upper end of the grip rod, two washers, an action block and a second large diameter rod. The shaft passes through the washers, a post portion of the action block and the second large diameter rod to let the action block freely rotate relative to the rod member. Then the leaf member is assembled with the action block tightly so that the leaf member may rotate relative to the rod member to suit to the direction of wind to let the leaves of the leaf member receive and be rotated by the wind.

1 Claim, 4 Drawing Sheets

TOY WINDMILL

BACKGROUND OF THE INVENTION

This invention relates to a toy windmill, particularly to one having a leaf unit alterable in its direction according to the wind so that the leaf unit always keeps on rotation, no matter any direction the wind may blow.

Traditional toy windmills generally have a rod, and an extension rod connected to an upper end of the to rod, and a leaf unit fixed on the extension rod. Then when wind blows on the leaf unit, the leaves of the leaf unit are rotated by the wind. The leaf unit cannot change its direction freely with the wind direction except the direction of the leaf unit has to be changed manually to suit to the wind direction.

SUMMARY OF THE INVENTION

The main purpose of the invention is to offer a toy windmill having a leaf member so connected to an extension shaft connected to a grip rod as to freely change its direction according to the wind direction, no matter the wind direction may be.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
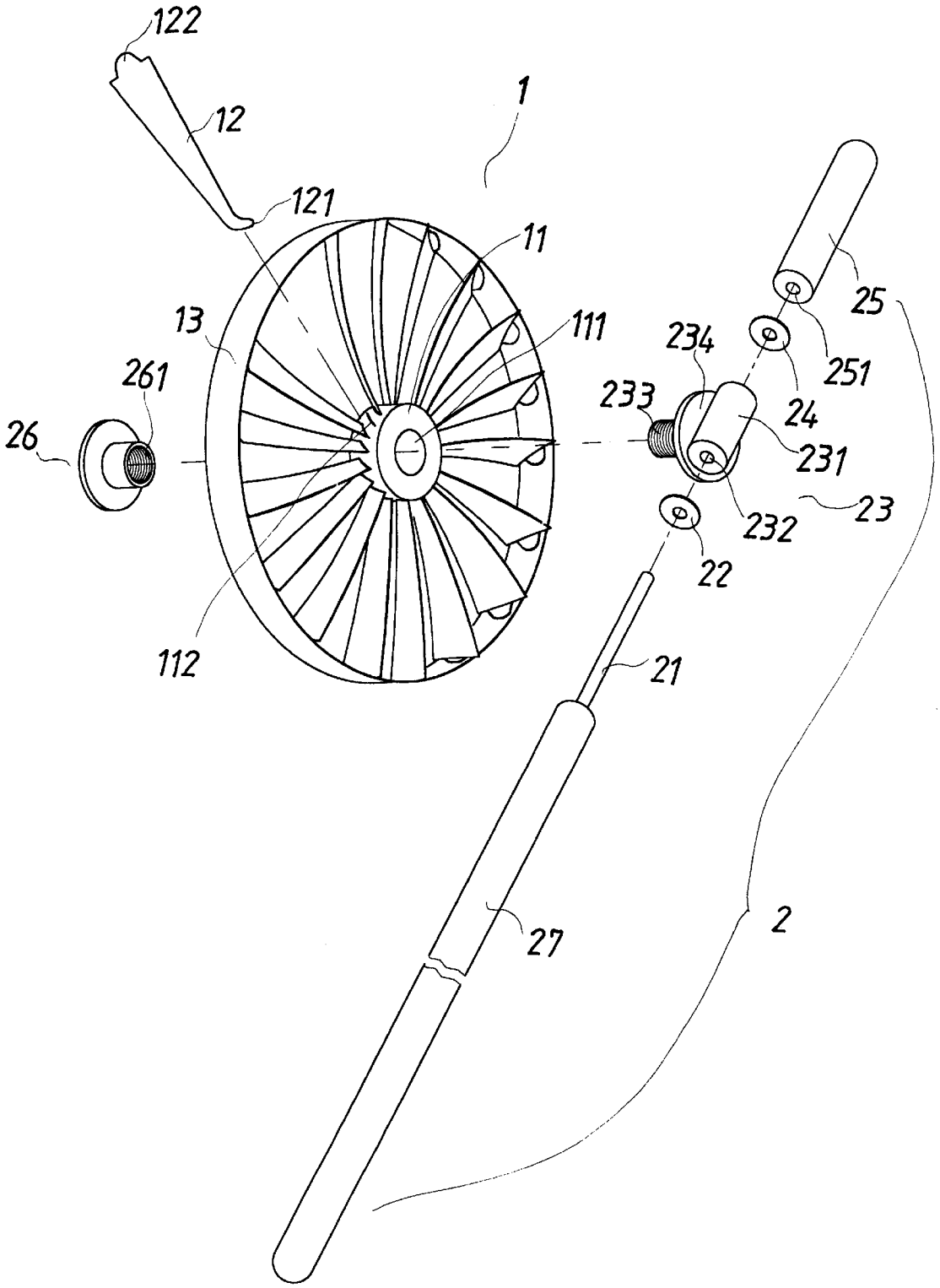
FIG. 1 is an exploded perspective view of a toy windmill of the present invention.

A preferred embodiment of a toy windmill in the present invention, as shown in FIG. 1, includes a leaf member 1 and a rod member 2 as main components.

The leaf member 1 consists of a center ring 11 with a center hole 111 and a plurality of position holes 112 spaced apart equidistantly and sloped in 45 degree in an outer spherical surface, a plurality of leaves 12, and a large outer ring 13. Each leaf 12 has an inner fitting end 121 fitting in each of the position holes 112 and an outer fixing end 122 fixed on an inner side of the large outer ring 13.

The rod member 2 consists of a first large diameter grip rod 27 and a small diameter extension shaft 21 extending up from an upper end of the first large diameter grip rod 27, a washer 22, an action block 23, another washer 24 and a second large diameter rod 25 orderly fitting around the small diameter extension shaft 21. The action block 23 has a post portion 231 with a center through hole 232 of a little larger diameter than that of the extension shaft 21 for the extension shaft 21 to pass through, and a bolt portion 234 with male threads 233 extending sidewise from the post portion 231. The male threads 233 engages tightly female threads 261 of a nut 26. The second large diameter rod 25 has a center hole 251 for the extension shaft 21 to fit tightly therein.

Figure 2:
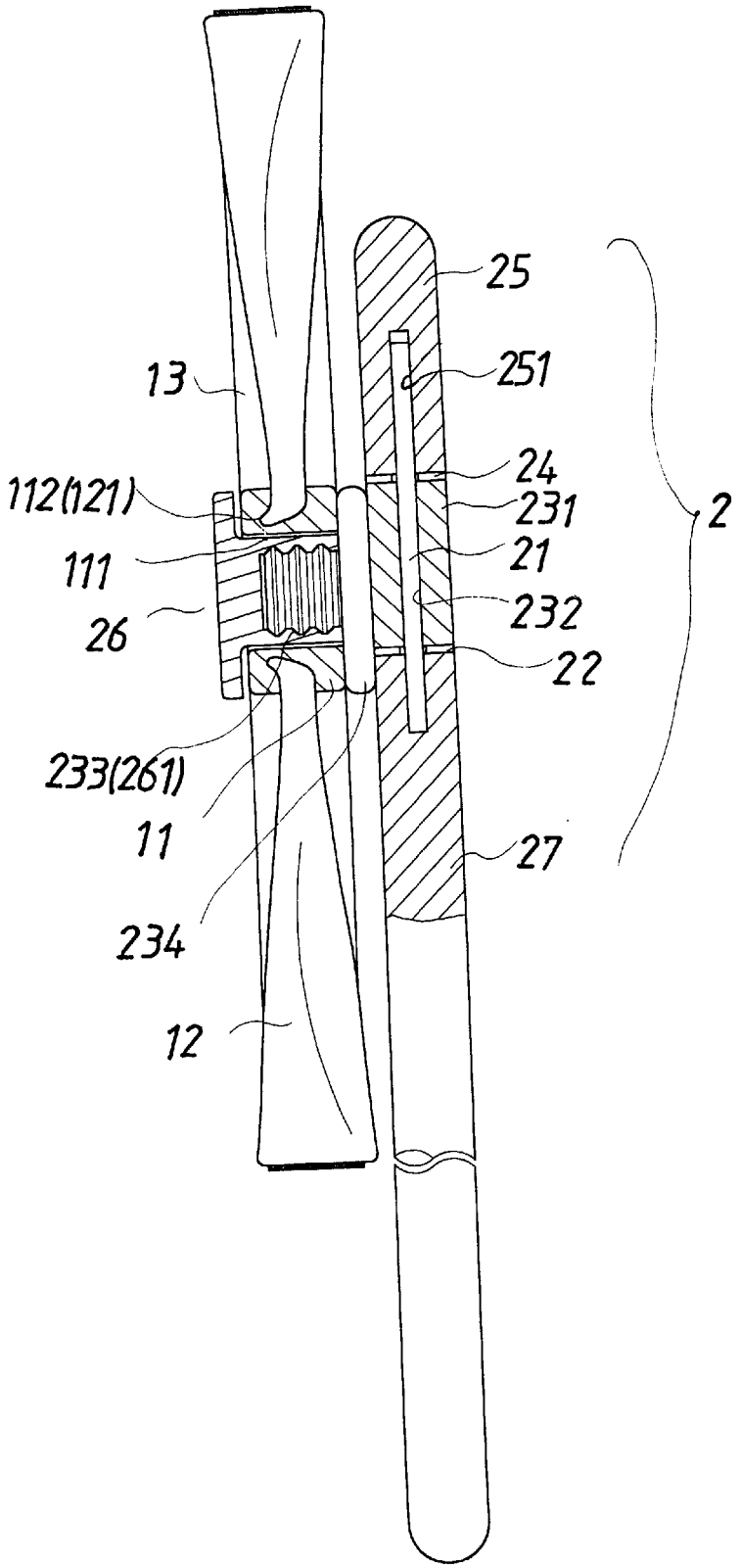
FIG. 2 is a cross-sectional view of the toy windmill of the present invention.
Figure 3:
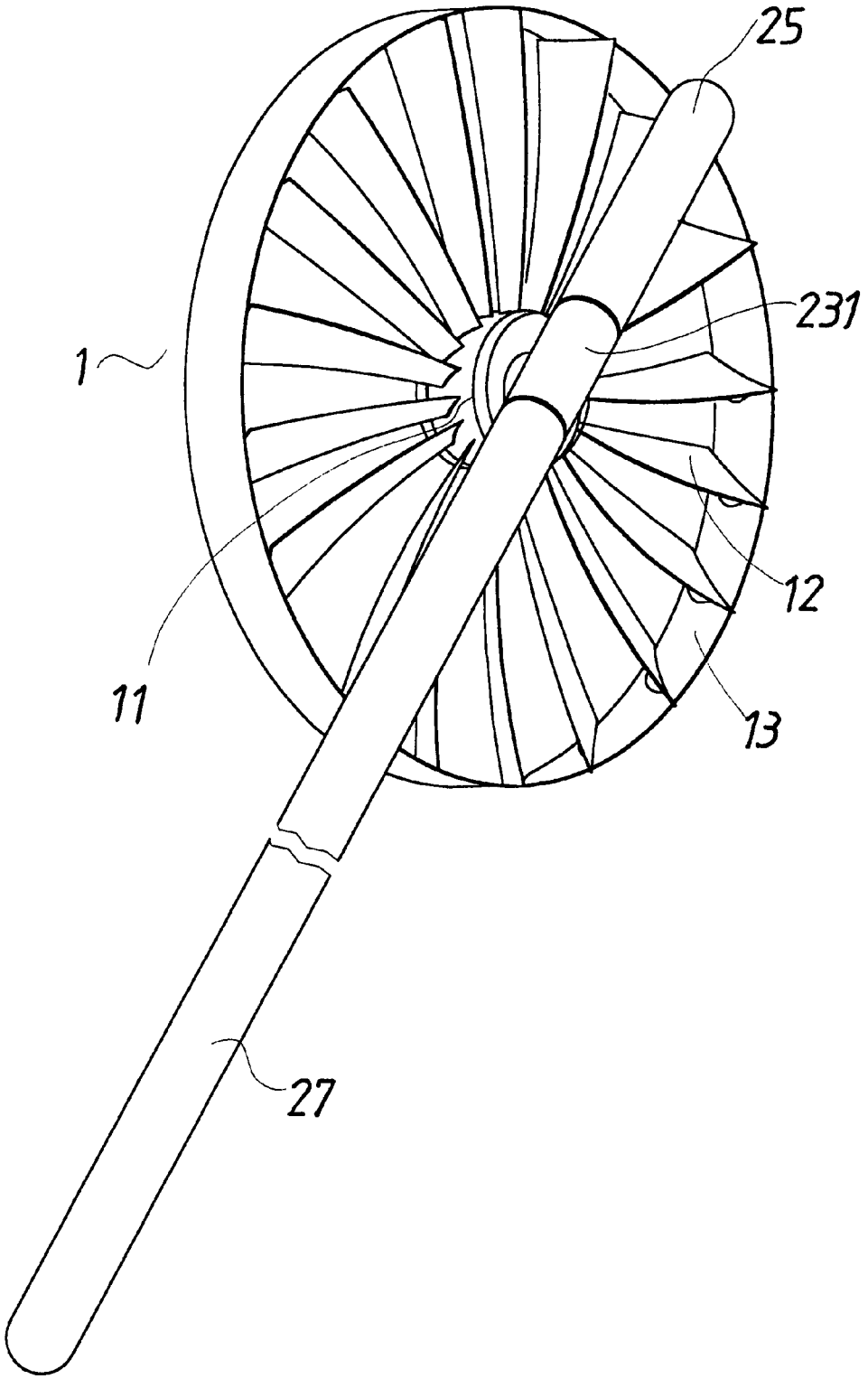
FIG. 3 is a perspective view of the toy windmill of the present invention; and, FIG. 4 is an upper cross-sectional view of the toy windmill of the present invention.

In assembling, referring to FIG. 2, firstly the washers 22, 24, the action block 23 and the second large diameter rod 25 are orderly fitted around the extension shaft 21. Next, the bolt portion 234 of the action block 23 is fitted in the center hole 111 of the inner ring 11, and then the nut 26 is engaged with the bolt portion 234, with the male threads 233 engaging the female threads 261 tightly. Thus the leaf member 1 is assembled with the rod member 2, forming the toy windmill in the invention, as shown in FIG. 3.

Figure 4:
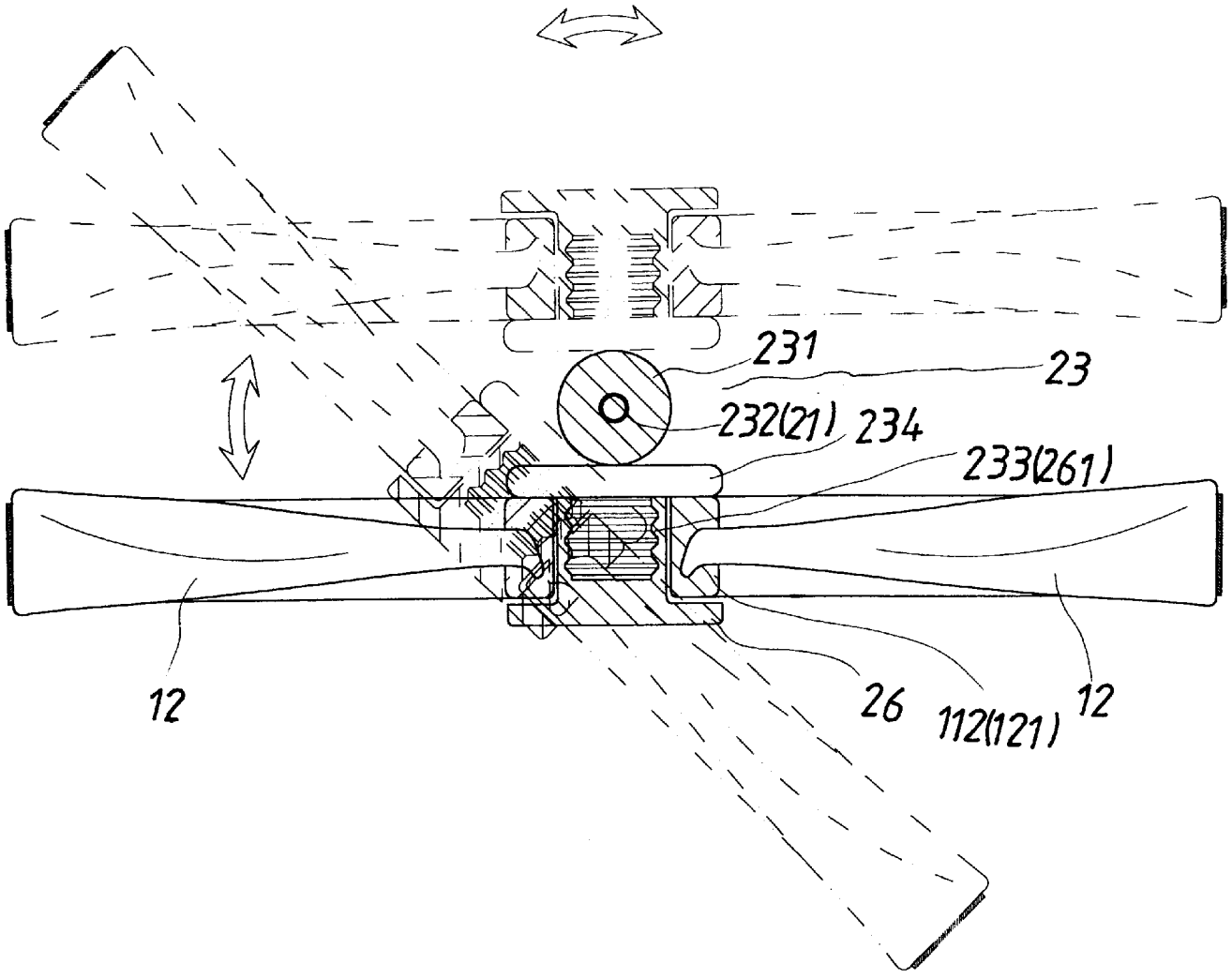

In using the toy windmill, referring to FIG. 4, as the post portion 231 of the action block 23 has the center hole 232 a little larger than that of the extension shaft 21 so that the action block 23 may freely rotate with the extension shaft 21 as a pivot. Therefore, when wind blows on and rotates the leaf member 1, the leaf member 1 may rotate also relative to the rod member 2 and changes its direction automatically, depending on the wind direction, always receiving the force of the wind to let the leaves rotate, so that it is distinct from traditional toy windmill.

What is claimed is:

1. A toy windmill comprising a leaf member and a rod member, said leaf member consisting of a small inner ring with a center hole and a plurality of position holes spaced apart equidistantly in an outer cylindrical surface, a large outer ring, and a plurality of leaves respectively having an inner fitting end and an outer fixing end, said inner fitting end fitting in one of said position holes of said inner ring, said outer fixing end fixed on an inner surface of said larger outer ring, and characterized by said rod member consisting of a first large diameter grip rod, a small diameter shaft extending up from an upper end of said large diameter grip rod, two washers, a action block and a second large diameter rod orderly fitted around said small diameter shaft, said action block having a post portion with a center through hole and a bolt portion extending sidewise from said post portion, a nut with female threads engaging said bolt portion of said action block, said second large diameter rod having a center hole for said small diameter shaft to fit tightly therein after said shaft passes through said center through hole of said post portion of said action block, said bolt portion of said action block fitted through said center hole of said inner ring of said leaf member after said rod member is assembled with said leaf member together, then said nut engaging said bolt portion of said action block of said rod member to assemble said leaf member stably with said rod member to constitute said toy windmill.

* * * * *